United States Patent [19]

Loechner

[11] Patent Number: 4,502,569

[45] Date of Patent: Mar. 5, 1985

[54] TRANSPORTABLE HEAVY-LIFT APPARATUS

[75] Inventor: Steven R. Loechner, Roanoke, Ind.

[73] Assignee: G & L Corporation, Fort Wayne, Ind.

[21] Appl. No.: 370,208

[22] Filed: Apr. 21, 1982

[51] Int. Cl.[3] ..... B66B 11/04

[52] U.S. Cl. ..... 187/17; 254/89 H; 248/346; 212/208

[58] Field of Search ..... 187/9 R, 17, 8.59, 8.41, 187/24; 254/89 H, 89 R, 93 R, 93 L; 414/10, 589; 248/346, 678; 212/208, 220, 221

[56] References Cited

U.S. PATENT DOCUMENTS

| | | | |
|---|---|---|---|
| 2,449,780 | 9/1948 | Jameson et al. | 254/89 H |
| 3,085,785 | 4/1963 | Peterson | 254/89 H |
| 3,146,903 | 9/1964 | Bjorklund | 212/220 |
| 3,622,124 | 11/1971 | Sidles et al. | 254/93 R |
| 3,632,088 | 1/1972 | Filipet | 254/89 H |
| 3,986,564 | 10/1976 | Bender | 254/93 R |
| 4,330,105 | 5/1982 | Gallagher | 254/89 R |
| 4,381,839 | 5/1983 | Engler et al. | 212/208 |

FOREIGN PATENT DOCUMENTS

| | | | |
|---|---|---|---|
| 2850544 | 6/1979 | Fed. Rep. of Germany | 254/89 H |

OTHER PUBLICATIONS

Riggers Mfg. Co. Inc. brochure entitled "E-Z Lift 500 Ton Telescopic Gantry".

Pp. 21, 46–47, *Transportation Engineer*, Apr. 1982.

*Primary Examiner*—Joseph J. Rolla

*Assistant Examiner*—Kenneth Noland

*Attorney, Agent, or Firm*—George A. Gust

[57] ABSTRACT

A transportable heavy-lift apparatus for moving heavy objects comprising a base housing having a plurality of cylinder members vertically supported therein, the cylinder members having a load platform attached to their top ends, and a fluid actuating system disposed in the base housing for vertically moving the cylinder members and load platform. The cylinder members are so arranged such that their common lift vector is substantially aligned with the center of the base housing, and the base housing is constructed such that load forces experienced when moving heavy objects is equally distributed throughout the base housing to its floor plate. Swivel lugs disposed in the top end portions of the cylinder members connect the load platform thereto. The fluid actuating system permits the cylinder members to be independently rapidly elevated to a lift position for an object.

5 Claims, 9 Drawing Figures

TRANSPORTABLE HEAVY-LIFT APPARATUS

BACKGROUND OF THE INVENTION

1. Field of the Invention

This invention relates to a lifting apparatus, and more particularly to a transportable heavy-lift apparatus capable of being transported to a distant site for lifting and moving heavy objects.

2. Description of the Prior Art

Current lifting apparatuses have the capability of lifting extremely heavy objects weighing several hundred tons. However, certain apparatuses may be difficult to move through doorways and/or under overhead objects because of their heights caused in part by large base housings supporting the vertical lift cylinders and rollers or wheels attached to the base housings, which possibly may even prevent transporting the apparatuses to an on-site lifting area within a building.

Once at the lifting site, certain apparatuses have an unduly prolonged set-up time partially caused by the slow upward movement of the cylinders to a lift position. These apparatuses provide cylinders with only one vertical speed, which is the same slow incremental movement used while lifting heavy objects.

Prior to and during the lifting sequence, extreme caution is generally required in positioning the lift apparatus relative to the object. Because certain apparatuses have minimal side strength in their base housings and are therefore incapable of withstanding extreme side forces, precise positioning of the base housings relative to the heavy objects is required vertually to eliminate horizontal load forces during the vertical lifting movement. Furthermore, because the base housings of these apparatuses have a somewhat elevated center of gravity, horizontal load forces acting on the elevated center of gravity may tend to dangerously tilt the apparatuses.

SUMMARY OF THE INVENTION

The present invention is shorter in overall height by the elimination of wheels and allowing the removal of portions of the load platform, thereby minimizing or elininating altogether difficulties experienced in moving the apparatus through doors and under overhead objects. Transporting and handling are facilitated because of the invention being of lighter weight than other available apparatus.

Set-up time of the apparatus of the present invention is decreased by providing a fluid power system capable of rapidly elevating the cylinders and load plate to the lift position. Generally, this is accomplished by providing two pumps on a common shaft in parallel in a two stage system to supply pressure fluid to the fluid power system. During no-load conditions both pumps operate simultaneously to provide an increased rate of pressure fluid flow to the fluid power system to increase the rate of movement of the cylinders, while during load conditions only one of the pumps supplies the pressure flow demands needed in lifting the heavy object.

The base housing of the apparatus of the present invention is capable of withstanding high horizontal load forces experienced during the lift sequence by equally distributing such forces to its floor plate. Positioned within the base housing is a plurality of intersecting inner walls which are interconnected with each other and with the top and floor plates of the base housing so that horizontal load forces applied to the top plate are transferred to the inner plates for uniform distribution over the floor plate. The center of gravity of the base housing is lowered by decreasing the depth and increasing the surface area of the fluid reservoir within the base housing, thereby decreasing the moment force caused by horizontal load forces which tend to tilt the apparatus.

Further strength and stability is provided to the present invention by arranging the cylinders within the base housing such that their common lift vector is substantially centered relative to the base housing to facilitate equal distribution of load forces to the floor plate.

Broadly stated, the present invention provides a transportable heavy-lift apparatus for moving heavy objects comprising a base housing having a floor plate, opposed side and end plates upstanding from the floor plate, a top plate secured to the side and end plates, and a plurality of interconnecting inner plates in the housing for uniformly distributing load forces from the top plate to the floor plate. Mounted within the base housing is a plurality of cylinders so arranged that their common vertical lift vector is substantially centered with respect to the base housing, and a load platform is attached to the top end portions of the cylinder members. Fluid actuating means is disposed in the base housing for vertically moving independently the cylinder members and the load platform, and includes at least two pumps in parallel for providing increased rate of pressure fluid flow to the cylinders to rapidly elevate the load platform to the load position.

It is an object of the present invention to provide a transportable heavy-lift apparatus having a decreased overall height compared to current lifting apparatuses.

Another object of the present invention is to provide a transportable heavy-lift apparatus having a shorter set-up time resulting from a fluid power system capable of rapidly elevating the cylinders and load platform under no-load conditions.

A further object of the present invention is to provide a transportable heavy-lift apparatus having increased capabilities of withstanding horizontal load forces by substantially uniformly distributing such forces to the floor plate of the base housing.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF THE PREFERRED EMBODIMENT

Figure 1:
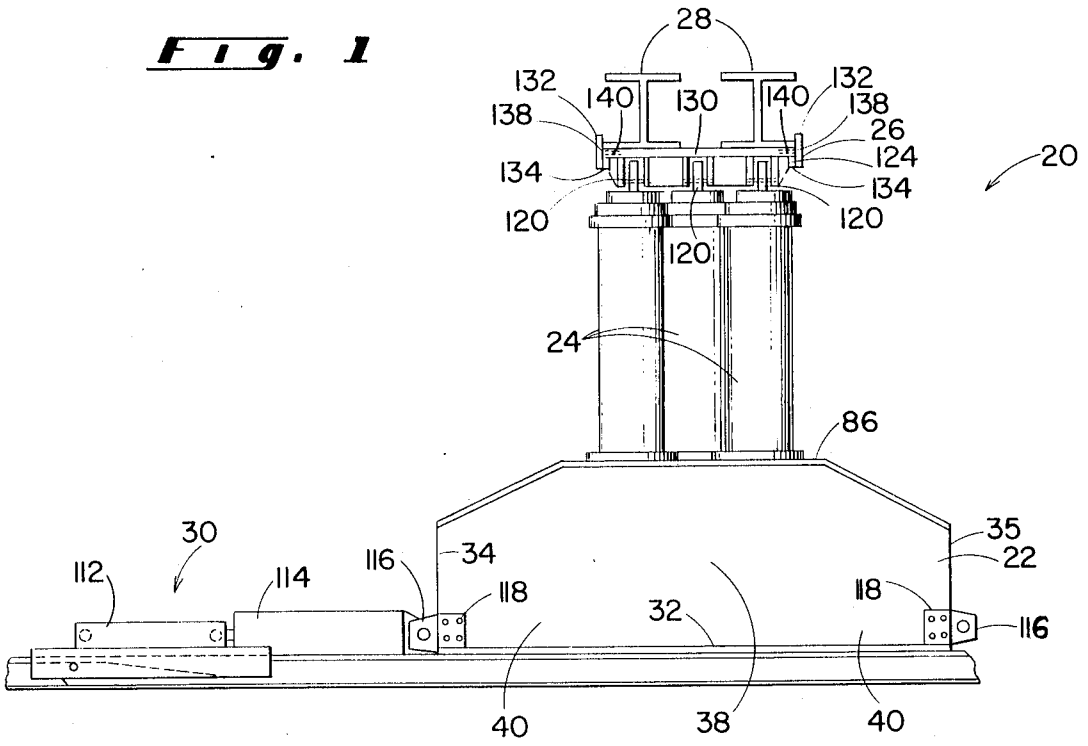
FIG. 1 is a side elevational view of an embodiment of the present invention.
Figure 2:
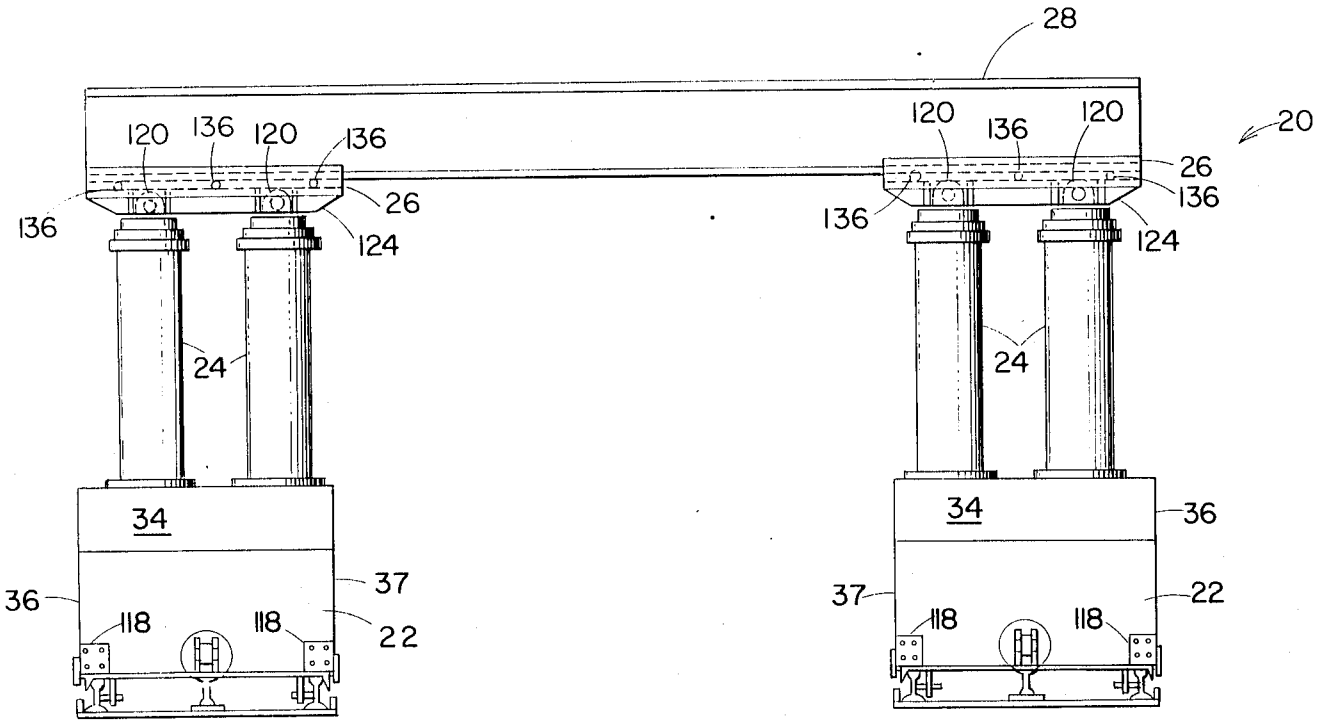
FIG. 2 is a front elevational view of the embodiment of FIG. 1.

Referring to FIGS. 1 and 2, transportable heavy lift apparatus 20 comprises base housings 22, cylinders 24 vertically supported by base housings 22, load platforms 26 attached to the top ends of cylinders 24, lifting beams 28 horizontally supported by load platforms 26, and moving device 30 attached to base housings 22.

Figure 3:
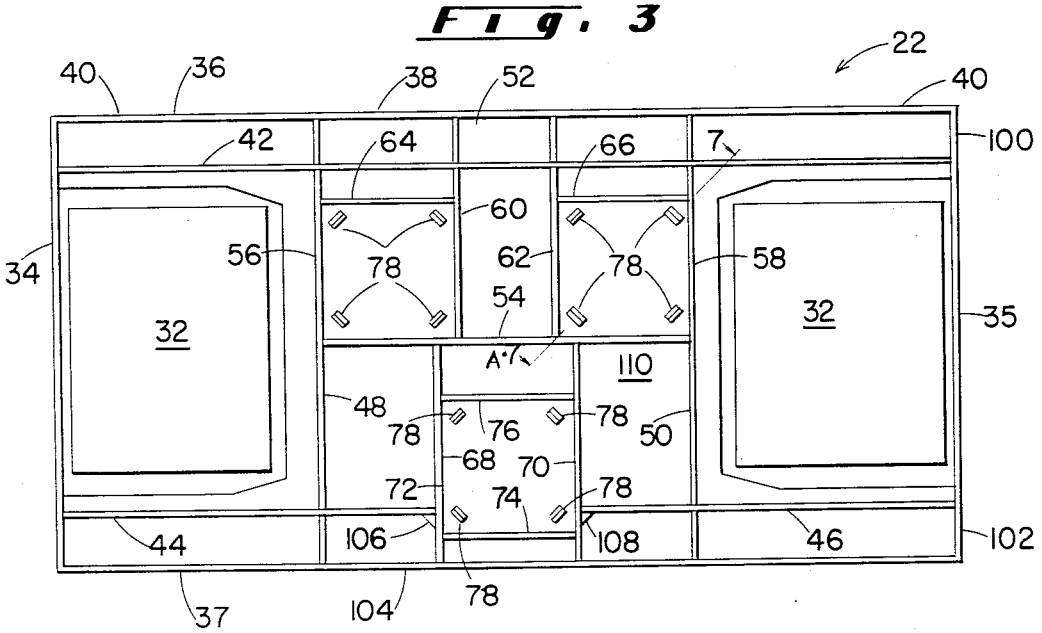
FIG. 3 is a top plan view of a base housing with the compression plate removed.

Referring now to FIGS. 1–5, and particularly FIG. 3, a description of a single base housing 22 will be given and will suffice for both. Base housing 22 includes floor plate 32 having vertically disposed end plates 34, 35 and side plates 36, 37 secured to its periphery by welding. Parenthetically, all further securements are made by welding unless otherwise indicated. In FIG. 1, it may be seen that side plates 36, 37 have substantially rectangular midsections 38 and sloping end sections 40 for reasons hereinafter disclosed Inner side plate 42 is spaced from and parallel to side plate 36 and secured to floor plate 32 and end plates 34, 35. Side plate 37 has a similar inner side plate assembly formed by inner side plates 44, 46 which are also secured to floor plates 32 and end plates 34, 35. Inner side plate 42 is unbroken and continuous between end plates 34, 35 and geometrically similar to side plate 36, while inner side plates 44, 46 are unbroken and continuous from end plates 34, 35, respectively, to points substantially centrally located in base housing 22 and are geometrically similar to like sections of side plate 37. Inner plate 48 extends between side plates 36, 37 and is secured to floor plate 32, side plates 36, 37 and is secured to floor plate 32, side plates 36, 37, and inner side plates 42, 44, and inner plate 50 likewise extends between side plates 36, 37 and is secured to floor plate 22, side plates 36, 37 and inner side plates 42, 46. Inner side plates 42, 44, 46 and inner plates 48, 50 form base housing midsection 52 which houses cylinders 24.

Extending midway between inner plates 48, 50 is center plate 54 secured to inner plate 48, 50 and floor plate 32, and forms one side of cylinder support frames 56, 58. Two parallel plates 60, 62 extend between center plate 54 and inner side plate 42 to form respective sides of cylinder support frames 56, 58, respectively, and are secured to center plate 54, inner side plate 42, and floor plate 32. Cylinder support frames 56, 58 are closed by plates 64, 66, respectively, extending between inner plate 48, plate 60 and inner plate 50, plate 62, respectively, frames 56, 58 thereby being box-shaped, having heights corresponding to the height of base housing 22.

Plate 68 extends between center plate 54 and side plate 37 and is secured to center plate 54, floor plate 32, side plate 37, and the end of inner side plate 44. Plate 70 is parallel to plate 68 and extends between center plate 54 and side plate 37, and is secured to center plate 54, floor plate 32, side plate 37, and the end of inner side plate 46. Plates 68, 70 form opposite sides of a third, box-shaped cylinder support frame 72 like frames 56, 58.

Figure 7:
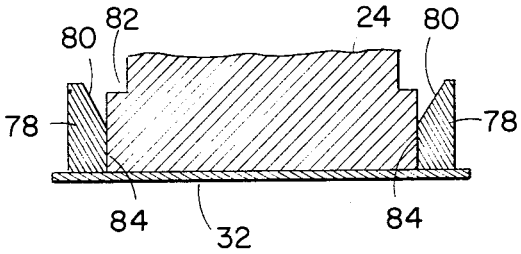
FIG. 7 is a partial sectional view of FIG. 3 along line 7—7 and viewed in the direction of the arrows.

Referring now to FIGS. 3 and 7, each cylinder support frame 56, 58, 72 has four chocks 78 disposed therein and welded to floor plate 32. The inwardly facing sides of chocks 78 have outwardly sloping upper portions 80 which facilitate the alignment and positioning of a respective cylinder 24 therebetween. Final positioning of a cylinder 24 within its respective cylinder support frame is attained when the bottom end of cylinder 24 rests on floor plate 32 and the enlarged annular end portion 82 of cylinder 24 abuts vertical lower portions 84 of chocks 78. Cylinders 24 are of conventional telescopic construction.

Figure 4:
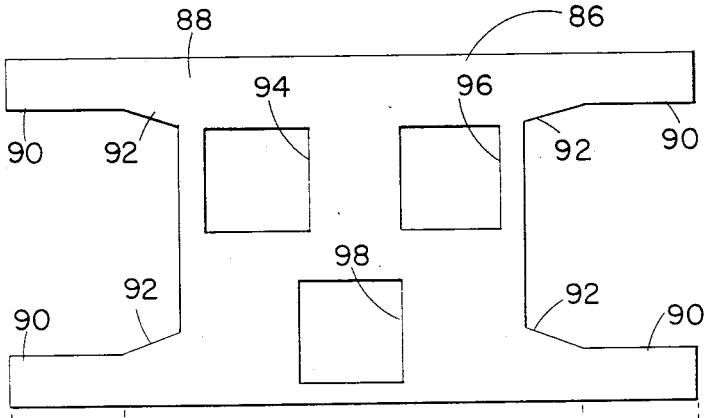
FIG. 4 is a top plan view of the top compression plate.
Figure 5:
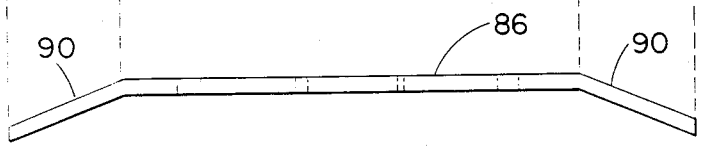
FIG. 5 is a side elevational view of the compression plate of FIG. 4.

Referring now to FIGS. 4 and 5, top plate 86 of base housing 22 comprises generally H-shaped midportion 88 having four extensions 90 extending angularly downwardly therefrom, four gussets secured at the corners of midportion 88, and openings 94, 96, 98 coinciding with cylinder support frames 56, 58, 72, respectively. After placing top plate 86 in position, it is welded to side plates 36, 37, end plates 34, 35, and at the joinder of the peripheries of openings 94, 96, 98 with their respective cylinder support frames 56, 58, 72. Thereafter, cylinders 24 are aligned with respective openings 94, 96, 98 and positioned within respective cylinder support frames 56, 58, 72.

As described, side plate 36, inner side plate 42, floor plate 32, top plate 86, and end plates 34, 35 form longitudinal box beam 100; inner side plates 44, 46, plate 74, side plate 37, floor plate 32, top plate 86, plates 68, 70, and end plates 34, 35 form longitudinal box beam 102; and inner plates 48, 50 and side plates 36, 37 form transverse box beam 104. Because box beam 102 is centrally interrupted by cylinder support frame 72, gussets 106, 108 are provided to strengthen box beam 104 against vertical shear forces. Box beams 100, 102, 104 and the plates forming cylinder support frames 56, 58, 72 receive and uniformly distribute cylinder load forces to floor plate 32. Further, horizontal load and moment forces are minimized because the arrangement of cylinders 24 within base housing 22 substantially aligns the common lift vector of cylinders 24 with the center of base housing 22; the common lift vector being represented at "A" which lies at the intersection of the lines bisecting the angles of the triangle formed by joining the centers of cylinders 24. Top plate 86 acts as a compression flange that serves to initially distribute cylinder load forces to box beams 100, 102, 104 for uniform distribution to floor plate 32, all of the plates previously described being upstanding and engaged at the top edges by compression plates 86.

The cylinder load forces uniformly distributed by base housing 22 tend to dissipate at the ends of base housing 22 and consequently side plates 36, 37 and inner side plates 42, 44, 46 have downwardly sloping end portions, thereby decreasing the overall weight and cost of apparatus 20.

Referring again to FIG. 3, the area enclosed by inner plate 48, inner side plates 42, 44, 46, plate 74, and end plate 35 serve as a fluid reservoir 110 containing sufficient fluid to operate apparatus 20. By using a majority of the interior space of base housing 22, the center of gravity of base housing 22 is lowered to further stabilize apparatus 20 during lift operations. Additionally, those plates within the area described by fluid reservoir 110 other than those sections of plates 68, 70 to which gussets 106, 108, respectively, are welded, have a plurality of holes therein adjacent to floor plate 32 to provide communication for and to minimize aeration of the fluid in reservoir 110. Minimization of aeration is important since the creation of gaseous bubbles within the fluid disrupts efficient operation of fluid hydraulic systems, and the minimization of splashing and sloshing, resulting from compartmentalizing reservoir 110 by baffled inner plates, maintains the majority of contaminating particles on the bottom of reservoir 110, thereby decreasing the concentration of contaminating particles in the fluid hydraulic system.

In the opposite end of base housing 22 there is mounted the fluid power system for apparatus 20 which will be described in detail hereafter. The open areas of base housing 22 between extensions 90 of top plate 86 may be closed by thin gauge sheet metal doors (not shown) hingedly or removably connected to top plate 86 to afford access to the fluid power system and reservoir 110.

Horizontal movement of base housing 22 over a surface is provided by moving apparatus 30 which comprises slider device 112 connected to hydraulic cylinder 114 which is pivotally connected to a respective lug 116 welded to a respective end plate 34, 35. Moving apparatus 30 is operated by a fluid power system of a base housing 22, and may be disassembled from base housing 22 at the connection of slider device 112 and hydraulic cylinder 114. A more detailed description of the structure and operation of moving apparatus 30 may be found in U.S. Pat. No. 3,659,823 issued to Griffin on May 2, 1972, and which patent is incorporated by reference herein.

Further stablizing support of apparatus 20 during lifting operations may be provided by connecting outrigger support members (not shown) to outrigger mount plates 118 at the corners of base housing 22.

Figure 6:
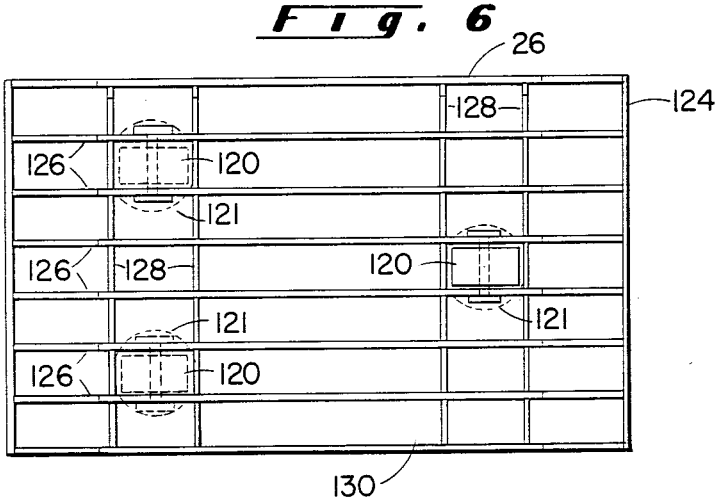
FIG. 6 is a bottom plan view of one of the two load platforms.
Figure 8:
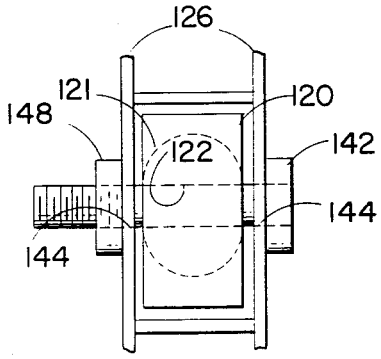
FIG. 8 is an enlarged top plan view of a swivel lug connected to the top end of a cylinder.

Referring to FIGS. 2, 6, and 8, each of the top ends of the protracting portion of cylinders 24 has a lug 120 thereon and to which load platform 26 is removably mounted. Each swivel lug 120 has a ball-shaped cavity which receives a ball swivel 121 providing a ball and socket arrangement which functions to provide rotational and pivotal movement. Each ball swivel 121 is provided with a hole 122 therein.

Referring now to FIGS. 1, 2, 6 and 8, a description of one load platform 26 will suffice for both platforms 26 since their structure and connection to cylinders 24 are identical. Load frame 124 of load platform 26 comprises six vertically disposed, spaced, parallel plates 126 and four vertically disposed, spaced, parallel plates 128 which intersect plates 126 as illustrated in FIG. 6. Plates 126, 128 are welded together and have end portions that slope inwardly, downwardly, which decreases the weight of load platform 26 while maintaining its load-carrying capability, as illustrated in FIGS. 1, 2. Cap 130 is secured, by welding for example, to the top edges of plates 126, 128, and side plates 132 (FIG. 1) are connected to the ends of cap 130 by screws 136 received through openings 138 in side plates 132 and tapped holes 140 in cap plate 130, thereby allowing the removal of side plates 132 to decrease the overall height of apparatus 20 if desired. Secured to the lower inner surfaces of side plates 132 are support plates 134 which counteract any side moment forces that may be applied by lifting beams 28.

Referring now to FIGS. 6 and 8, load platform 26 is mounted on three cylinders 24 by positioning swivel lugs 120, 121 through respective openings formed by the intersections of plates 126 with plates 128. The swivel lugs 120, 121 are secured thereto by passing bolts 142 through holes 144, ball swivel holes 122 and threading nuts 148 thereon. By means of this swivel mounting, the platform 26 may be tilted to any desired angle by selective operation of the cylinders 24.

Figure 9:
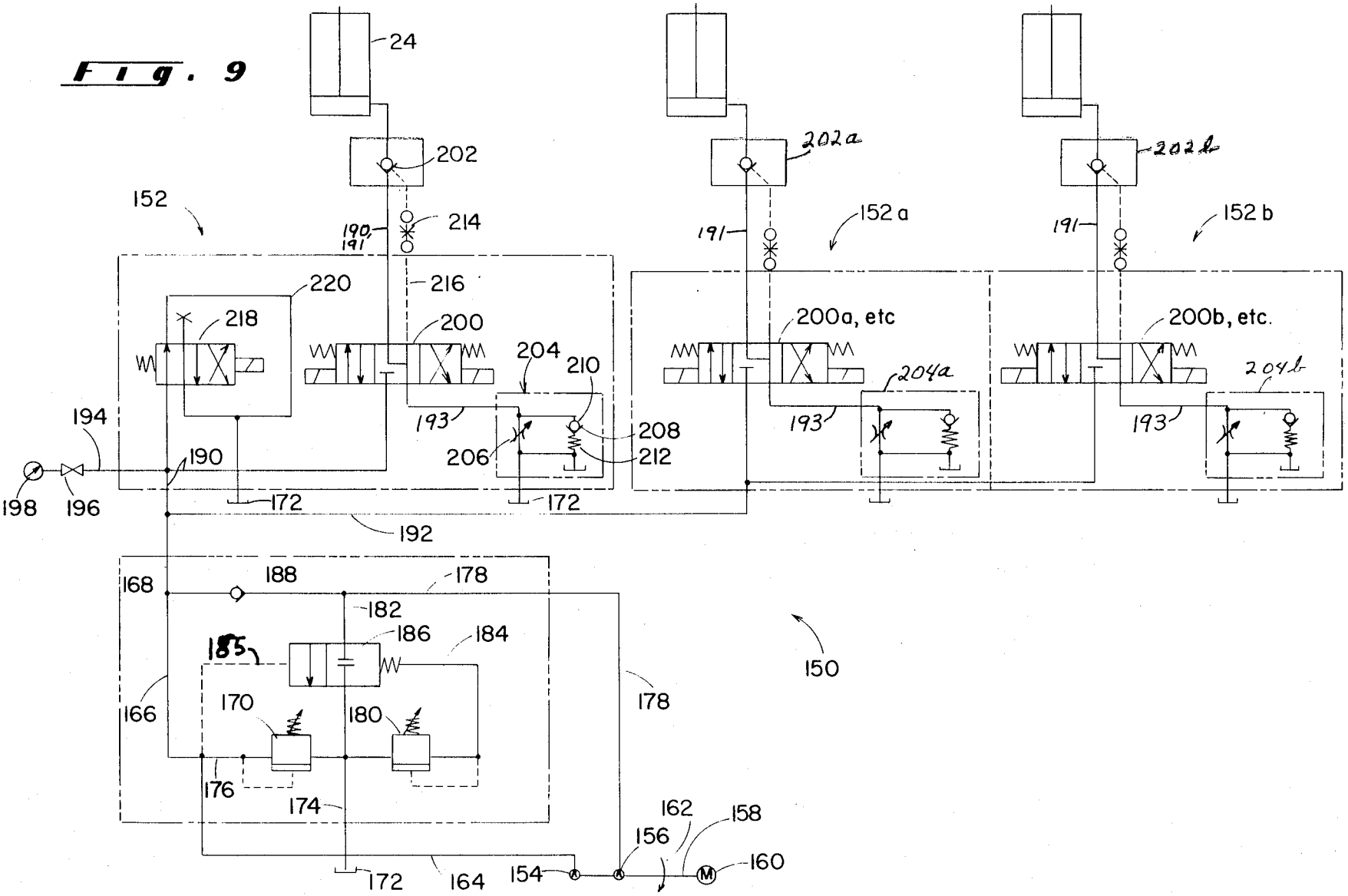
FIG. 9 is a schematic of a fluid power system for the embodiment of FIG. 1.

Referring now to FIG. 9, the fluid power system of apparatus 20 is electrically controlled and hydraulically operated, and permits the two sets of three cylinders 24 in respective base housings 22 to be independently operated. The fluid power system for a single base housing 22 comprises pump system 150 connected in parallel to three fluid control systems **152, 152*a*, 152*b* for respective cylinders 24. For purposes of description, only one of the three identical fluid control systems 152 will be explained. Beginning with pump system 150, pumps 154, 156 are connected to shaft 158 and motor 160 by adaptor coupling 162. Both pumps 154, 156 operate simultaneously with pump 154 providing pressure fluid at 2200 psi at a flow rate of four gallons per minute and pump 156 providing pressure fluid at 800 psi at a flow rate of eight gallons per minute for a total pressure of 2200 psi at a flow rate of twelve gallons per minute under no-load conditions. Pump 154 is connected by line 164 and line 166 to output line 168, and is further connected by pressure relief valve 170 to tank 172 by lines 174, 176. Pressure relief valve 170 is preset and pressure sensitive and allows pressure fluid to flow to tank 172 when the pressure exceeds 2200 psi. In a similar manner, pump 156 is coupled to output line 168 by line 178 and check valve 188, and pressure relief valve 180 is coupled between the pilot of pilot operated check valve 186 and tank 172. Valve 186 is coupled by lines 182 and 174 to tank 172. When system pressure exceeds 800 psi, as measured in lines 166, 168, pilot operated check valve 186 and pressure relief valve 180 will open due to pressure in pilot line 185 and line 184 providing minimal flow via lines 178, 182, 174 to tank 172. Check valve 188 is coupled to line 178 between lines 168 and 182 to prevent pressur fluid flow back to pump 156 when pressure in line 168** exceeds 800 psi.

The combination of valves 180 and 186 serve conjointly to relieve pressure in line 178 when such pressure exceeds a value of 800 psi, the valve 180 being preset for the purpose. The valve 180 is connected into the pilot circuit of valve 186 such that the pressure of fluid in line 185 is coupled to valve 180. Thus, pressure fluid in line 185 couples to the pilot in valve 186 as well as to relief valve 180. Assuming that valve 180 is preset to 750 psi and about 50 psi is required to operate the pilot in valve 186, a total pressure of 800 psi in line 185 will operate the pilot to open valve 186 and also valve 180. In actuality, valve 180 determines the opening pressure of valve 186, only minimal flow of pressure fluid from line 185 to valve 180 occurring.

The two pumps 154 and 156 on shaft 158 in combination with the circuitry of valves 170, 180, 186 and 188 serve as a two stage system which under no-load, as determined by the back pressure in line 168, delivers twelve gallons per minute until the pressure in line 168 builds to a value exceeding 800 psi, at which time flow drops to four gallons per minute.

Output line 168 delivers pressure fluid to lines 190 and 192, which deliver pressure fluid to the fluid control systems **152, 152*a* and 152*b*. Tap line 194 having needle valve 196 and pressure gauge 198 coupled thereto is connected to line 190 for monitoring pressure conditions at points prior to fluid control systems 152**.

In fluid control system 152, directional control valve 200 and pilot operated check valve 202 are coupled to a cylinder 24 by line 190, 191. Directional control valve 200 allows the direction of pressure fluid to cylinder 24 to be externally controlled, and check valve 202 prevents loss of pressure fluid to cylinder 24 under loss of power conditions or when it is desired to hold cylinder 24 in protracted position. Assuming the directional control valves **200, 200*a* and 200*b* are simultaneously actuated, all three cylinders 24** will be correspondingly protracted.

The descent and retraction of load platform 26 and cylinders 24, respectively, are controlled by conventional metering control valves 204 in each fluid control system 152, 152*a*, 152*b* which are coupled to the respective directional control valve 200, 200*a*, 200*b* and sump 172. Each metering control valve 204 comprises in parallel an adjustable metering needle valve 206. Spring check valve 208 provides a constant rate of fluid flow under varying pressures to sump 172 by narrowing its orifice under high pressure, which forces ball 210 against spring 212, and widening the orifice during low pressures, which allow spring 212 to lift ball 210. Adjustment of metering control valve 204, 204*a*, 204*b* determines the descent speed of the respective cylinder 24. Also provided for power-loss conditions is quick disconnect 214 coupled to line 216, which runs in parallel with line 190 between check valve 202 and sump 172. Quick disconnect 214 allows an auxiliary power source to be connected thereto to operate check valve 202 in order to lower and retract load platform 26 and cylinders 24, respectively.

In order to retract a given cylinder 24, the respective directional control valve 200, 200*a*, 200*b* is operated by means of an electrical circuit (not shown) to its pilot which shifts pressure line 190, 192 to line 216 to unseat the respective check valve 202. Also, line 191 is disconnected from pressure line 190, 192 and line 191 is connected to line 193 to permit pressure fluid to drain from the cylinder 24 through the respective metering control valve 204, 204*a*, 204*b* to sump 172. Thus, the check valves 202, 202*a*, 202*b* may be considered as being pilot operated by the respective directional control valves 200, 200*a*, 200*b*.

Pressure fluid return flow to sump 172 under conditions during which cylinders 24 are in stationary position, is provided by venting valve 218 which is coupled to sump 172 by line 220. Under such conditions, venting valve 218 allows pumps 154 and 156 to operate without providing pressure fluid to the three fluid control systems 152. The check valves 202, 202*a*, 202*b* hold the cylinders 24 in a given elevated position.

In a typical sequence of operating apparatus 20 at a distant lifting site, base housings 22 having their respective cylinders 24 and load platforms 26 retracted are easily transported on a flat bed trailer. The overall minimal height of each base housing 22 contributes to the relatively low height of platform 26 during transport, and facilitates movement from a storage area to a work site. Assuming that it is desired to move a heavy object, such as a multi-ton transformer, factory press, or the like, over the surface to a predetermined location, the gantry is assembled as shown in FIG. 2 with base and cylinder assemblies 22, 24 on opposite sides thereof. Thereafter, hydraulic cylinder 114 is connected to slider device 112. Lifting beams 28 are resting on load platforms 26 and a suitable cable is connected to lifting beams 28 and the heavy object. If not earlier accomplished, side plates 132 are then secured to load frame 124 of load platform 26 to prevent lifting beams 28 from possibly sliding thereoff.

The recommended procedure to begin the lift operation is to close diverter valve 218 by means of its electrically actuated pilot prior to starting pumps 154, 156 to allow correct pressure build up and to check for correct operation of the fluid control systems 152. After completing all desired checks, diverter valve 128 is then opened and pressure fluid under approximately 2200 psi at a flow rate of approximately twelve gallons per minute is devlivered to cylinders 24 by respective fluid control systems 152, 152*a*, 152*b*. During no-load condition, which occurs while lifting beams 28 are elevated to take up slack in the cable, the combined pressure fluid provided by pumps 154, 156 causes lifting beams 28 to rapidly elevate to the lift position at which load conditions exist, i.e., when the slack on the cable has been taken up. At the lift position, pressure fluid demands are increased beyond 800 psi which closes check valve 188 and drops pump 156 off line. Thereafter, pump 154 provides the increased pressure fluid demands, up to 2200 psi, to extend cylinders 24 at a slow rate carrying load platforms 26 and lift beams 28.

Vertical and horizontal load forces transferred from cylinders 24 to base housings 22 are uniformly distributed and centrally distributed to floor plate 32 by top plate 86, the interconnecting plates within base housing 22, and the positioning of the three cylinders 24 on each base 22. Independently operating cylinders 24 allow each load platform 26 to be properly leveled. The individual control cylinders 200, 200*a*, 200*b* may also be separately operated to tilt platform 26 as may be desired. Vertical load forces experienced during the lift operation are substantially centrally distributed to floor plate 32 because of the structure of base housings 22 and the alignment of the common lift vector of three cylinders 24 with the respective center of a base housing 22.

Horizontal movement of the heavy object is then provided by moving apparatus 30, which operation is more fully described in U.S. Pat. No. 3,659,823, incorporated by reference herein. Once the object is moved to a desired location, the above procedure is reversed by opening check valves 202, 202*a*, 202*b* to lower the object and return apparatus 20 to its storage area.

An advantage residing in apparatus 20 is the relatively low overall height because of the design of base housing 22, and the capability of removing side plates 132 from cap plate 130. The reduction of overall height makes apparatus 20 easier to move through doorways or passages for transportation to the lifting site.

Once at the lifting site, another advantage of apparatus 20 is its rapid lifing time which is facilitated by the relatively rapid elevation of beams 28 under no-load conditions.

A further advantage of apparatus 20 is its capability of uniformly and centrally distributing load forces to floor plates 32 of base housing 22 due to the alignment of the common lift vectors of the cylinders with the respective centers of their base housings 22 and the interconnecting plate structures of base housing 22.

Given in the following are dimensions of a typical working embodiment of apparatus 20 and which are exemplary only and not limitations of the invention. The scope of the invention is given in the appended claims.

| | |
|---|---|
| Floor plate 32: | |
| Length | 8 feet |
| Width | 4 feet |
| Thickness | 1½ inch |
| End plates 34, 35: | |
| Length | 4 feet |
| Height | 2 feet |
| Thickness | ½ inch |
| Side plates 36, 37: | |
| Length | 8 feet |

-continued

| | |
|---|---|
| End height | 2 feet |
| Thickness | ½ inch |
| Midsection 38: | |
| Length | 4 feet |
| Height | 3 feet |
| Thickness | ½ inch |
| Inner side plate 42 | Same as side plates 36, 37 and midsection 38 |
| Inner side plates 44, 46: | |
| Length | 3 feet 5 inches |
| Maximum height | 3 feet |
| Minimum height | 2 feet |
| Thickness | ½ inch |
| Inner plates 48, 50: | |
| Length | 4 feet |
| Height | 3 feet |
| Thickness | 1¼ inch |
| Midsection 52: | |
| Length | 3 feet 2 inches |
| Width | 4 feet |
| Height | 3 feet |
| Center plate 54: | |
| Length | 3 feet 2 inches |
| Height | 3 feet |
| Thickness | 1¼ inch |
| Cylinder support frames 56, 58, 72: | |
| Length | 1 foot 2 inches |
| Width | 1 foot 2 inches |
| Height | 3 feet |
| Plates 60, 62: | |
| Length | 1 foot 6 inches |
| Height | 3 feet |
| Thickness | 1¼ inch |
| Plates 64, 66: | |
| Length | 1 foot 2 inches |
| Height | 3 feet |
| Thickness | 1¼ inch |
| Plates 68, 70: | |
| Length | 2 feet |
| Height | 3 feet |
| Thickness | 1¼ inch |
| Plates 74, 76: | |
| Length | 1 foot 2 inches |
| Height | 3 feet |
| Thickness | 1¼ inch |
| H-shaped midportion 88 of top plate 86: | |
| Maximum length | 4 feet |
| Minimum inner length | 3 feet |
| Width | 4 feet |
| Thickness | 1¼ inch |
| Extensions 90: | |
| Length | 2 feet |
| Width | 8 inches |
| Thickness | 1¼ inch |
| Openings 94, 96, 98: | |
| Length | 1 foot 2 inches |
| Width | 1 foot 2 inches |
| Thickness | 1¼ inch |
| Box beam 100: | |
| Length | 8 feet |
| Width | 6 inches |
| Maximum height | 3 feet |
| End height | 2 feet |
| Box beams 100, 102: | |
| Length | 3 feet 5 inches |
| Width | 6 inches |
| Maximum height | 3 feet |
| End height | 2 feet |
| Load platform 26: | |
| Length | 4 feet |
| Width | 3 feet |

While there have been described above the principles of this invention in connection with specific apparatus, it is to be clearly understood that this description is made only by way of example and not as a limitation to the scope of the invention.

What is claimed is:

1. A transportable heavy-lift apparatus for moving heavy objects, comprising:

a base housing having a floor plate, opposed side plates and opposed end plates upstanding from said floor plate to form a continuous wall, a top plate secured to said continuous wall, and means in said base housing for substantially uniformly distributing load forces to said floor plate, a plurality of cylinder members being vertically supported by said base housing in an arrangement that substantially aligns the common vertical lift vector of said cylinder members with the center of said base housing, a load platform attached to the top end portions of said cylinder members, and fluid actuating means disposed in said base housing for vertically moving said cylinder members and said load platform, whereby load forces received by said cylinder members in moving an object carried on said load platform are substantially uniformly distributed to said base housing floor plate by said distributing means, said distributing means comprising a plurality of selectively arranged interconnecting inner plates secured to and between said floor and top plates, two of said inner plates being spaced apart and extending between said side plates to define a base housing midportion therebetween, and base housing end portions between respective ones of said two inner plates and said end plates.

2. The apparatus of claim 1 wherein said base housing midportion and one of said base housing end portions form a fluid reservoir for containing a fluid for said fluid actuating means, said inner plates disposed in said base housing midportion and said one base housing end portion having holes therein to provide fluid communication between said base housing midportion and said one base housing end portion to minimize fluid turbulance during movement of said base housing, and said fluid actuating means is disposed in the other said base housing end portion.

3. The apparatus of claim 2 wherein said plurality of cylinder members includes three of said cylinder members vertically disposed in said base housing midportion and having their bottom end portions in said fluid reservoir and supported on said floor plate, two of said cylinder members being in spaced apart tandem relation so that the plane containing their longitudinal axes is substantially parallel to said side plates of said base housing, and the third of said cylinder members being spaced apart from said two cylinder members and substantially centered between the longitudinal axes thereof.

4. The apparatus of claim 3 further including means for moving said base housing over a surface.

5. The apparatus of claim 4 further including a second like apparatus, said apparatuses being spaced apart and having the end portions of a support member positioned on respective said load platforms, said support member being connectable to an object to be moved, whereby, upon actuation of said fluid actuating means to extend said cylinder members to raise said support member, the object is lifted from a surface, and, upon operating said moving means of said base housing, moved over a surface.

* * * * *